US005309853A

United States Patent [19]

Gazzarrini, deceased

[11] Patent Number: 5,309,853

[45] Date of Patent: May 10, 1994

[54] APPARATUS FOR THE AUTOMATIC POSITIONING OF STOCKINGS IN A PANTYHOSE-SEWING MACHINE

[75] Inventor: Vinicio Gazzarrini, deceased, late of Impruneta, Italy, by Alma Gazzarrini, executrix

[73] Assignee: Solis S.r.l., Tavarnuzze, Italy

[21] Appl. No.: 30,570

[22] Filed: Mar. 12, 1993

[30] Foreign Application Priority Data

Mar. 13, 1992 [IT] Italy ..... FI92 A 000067

[51] Int. Cl.[5] ..... D05B 21/00

[52] U.S. Cl. ..... 112/121.15

[58] Field of Search ..... 112/121.12, 121.15, 112/27, 262.2

[56] References Cited

U.S. PATENT DOCUMENTS 5,058,516 10/1991 Maegawa et al. ..... 112/121.15 X

FOREIGN PATENT DOCUMENTS

48530A90 11/1989 Italy .

*Primary Examiner*—Clifford D. Crowder

*Assistant Examiner*—Paul C. Lewis

*Attorney, Agent, or Firm*—McGlew & Tuttle

[57] ABSTRACT

Apparatus for the automatic positioning of stockings in a pantyhose-sewing machine, with detection of the garter line 17, and including two binate stocking-holding shapes 13, each of which has two horizontal articulated arms 10 extended ends joined by a nylon bow 7, wherein the stems 71, 72 of the bow 7 are slidingly housed within the arms 10, 30 of the clamp 13, a driving and guiding device being provided inside the arm 10 of the clamp 13, with a bored rod 4 on top of which one stem 71 of the bow 7 is fixedly engaged; the foot of the other stem 72 being loosely received in a hole 11 of the other arm of the clamp 13; with a hose 1 fixedly fitted on a second hose 2 internally gauged for guiding the shoe 5 of the rod 4, on top of the hoses a bush 3 being fixed for guiding the end of the rod 4; with a thrust spiral spring 5 fitted on the rod 4 inside the hose 2 and suitably pressed between the bush 3 and the shoe 5 of the rod 4; and with a device for driving the retraction or withdrawal of the stretching bow 7 of out of the arms of the clamp 13.

5 Claims, 6 Drawing Sheets

APPARATUS FOR THE AUTOMATIC POSITIONING OF STOCKINGS IN A PANTYHOSE-SEWING MACHINE

FIELD OF THE INVENTION

The present invention refers to an apparatus for the automatic positioning of stockings in a pantyhose-forming machine, with automatic detection of the garter line.

BACKGROUND OF THE INVENTION

It is known to make pantyhose articles by suitably cutting two stockings lengthwise from the open end, that is, from the elastic hem of the bodice, to a point spaced a predetermined distance from the garter line which separates the bodice from the leg and, afterwards, by sewing together the juxtaposed edges of the thus cut stockings. To this end, the two stockings to be sewn to form a pantyhose article are first fitted on two binate or paired juxtaposed shapes, then they are lined up vertically and brought close to each other, so as to provide a correspondence between the elastic hem and the garter lines thereof.

Owing to the above mentioned correspondence, the longitudinal cut leads to the definition of two edges of equal length and equally located with respect to the garter line. In a successive step, the juxtaposed edges of the two stockings are sewn together to form a pantyhose article: the seams being carried out throughout the length of the edges.

It thus follows that in order to carry out the cut with the necessary accuracy, the garter line must be distinctly sensed.

Devices are known to overcome this problem for detecting the garter on a stocking, and these devices are provided with optical sensors able to sense the difference of consistency between the fabric of the stocking leg and that of the bodice.

But, for the sensors to distinctly detect the garter line it is necessary to dispose the stocking in stretched attitude in a correspondence with the sensors, that is, with the stockings in a wrinkle-free condition.

A device is known from the Japanese Patent No. 1-312.410 for positioning the stockings in a pantyhose-making machine. This device is provided with first optical sensors to detect the presence of the stockings over the relevant paired shapes, and these first sensors are associated with means for longitudinally sliding the stockings over the shapes.

Second optical sensors are used for sensing the garter line of the thus disposed stockings. These second sensors are associated which means for transferring the garter lines to a predetermined position over the shapes.

Third optical sensors for sensing the elastic edge of the stockings and these third sensors are associated with means for transferring the stockings to a predetermined position over the shapes.

The operation of this known device may be described as follows.

The two stockings to be combined to obtain a pantyhose article are fitted in bulk over the two paired shapes. As soon as the sensors for the detection of the stockings sense the presence thereof, the means for positioning the elastic hems take over the latter and put them thoroughly onto the shapes, as far as the stocking regions with the garter line result fitted on the shapes and allow the detection thereof by the corresponding sensors. Thereafter, means associated to the sensors provide for aligning the two garter lines. Finally, the sensors for detecting the elastic hem of the stockings move forward to a predetermined alignment position, and the associated means for positioning the elastic hems provide for the transfer thereof up to the alignment position. At this point, the stocking bodices are stretched wrinkle-free over a predetermined length and with the elastic hems and garter lines lined up vertically in order to properly carry out the subsequent cutting operation.

Yet, this known positioning device exhibits some drawbacks, the major of which being the need of moving the elastic hem and the leg of each stocking in two distinct steps and by means of different positioning members which must operate separately. This implies a higher constructional complexity of the machine, which is detrimental to the economy of production and running of the latter. Moreover, owing to the constructional complexity of the known device, the reliability of the machine provided with such device is heavily reduced, which brings about more frequent service interventions and longer dwell or down times. A further drawback is that the whole time necessary to make a pantyhose article is heavily affected by the speed at which the operations for positioning the stockings over the relevant shapes are carried out. When the making of a pantyhose article is to be sped up as much as possible—and considering that it is not possible at present to reduce the stockings-cutting and sewing times any further—it is impossible to attain very close tolerance limits in the detection of the garter lines, which implies inaccuracies in the pantyhose formation.

SUMMARY AND OBJECTS OF THE INVENTION

This invention has the object to eliminate the above mentioned drawbacks without increasing the length of the shapes.

This result has been achieved, according to the invention, by adopting the idea of providing a device for the automatic positioning of the stockings in a pantyhose-forming machine and comprising two superimposed paired shapes for the support of the stockings, the arms of each shape being extended and joined at the ends thereof by a coplanar nylon bow wherein the stems of the bow are engaged with driving means, along the clamp arms, between two positions, one of maximum retraction, to allow the stocking to be fitted over the clamp, and the other of maximum extraction or, to allow the bodice and the upper portion of the stocking leg to be stretched even further, that is, outwardly of the clamp, so as to detect the garter line outside, that is, before the clamp tip which supports the relevant stocking.

The advantages attained from the present invention lie essentially in that it is possible to obtain the stretching of the bodice and the upper region of the leg of each stocking in a single step and with the same driving means; that time for the formation of a pantyhose article is greatly reduced or, otherwise, the formation time being equal, the driving speed of the stockings is significantly reduced, to the advantage of the accuracy of detection of the garter lines and, accordingly, of the quality of the formed pantyhose articles; that the proposed apparatus is easy to make and, thus, cost-effective and reliable even after a prolonged use; that the machines for pantyhose production currently available may be easily and rapidly equipped with an apparatus according to the invention.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
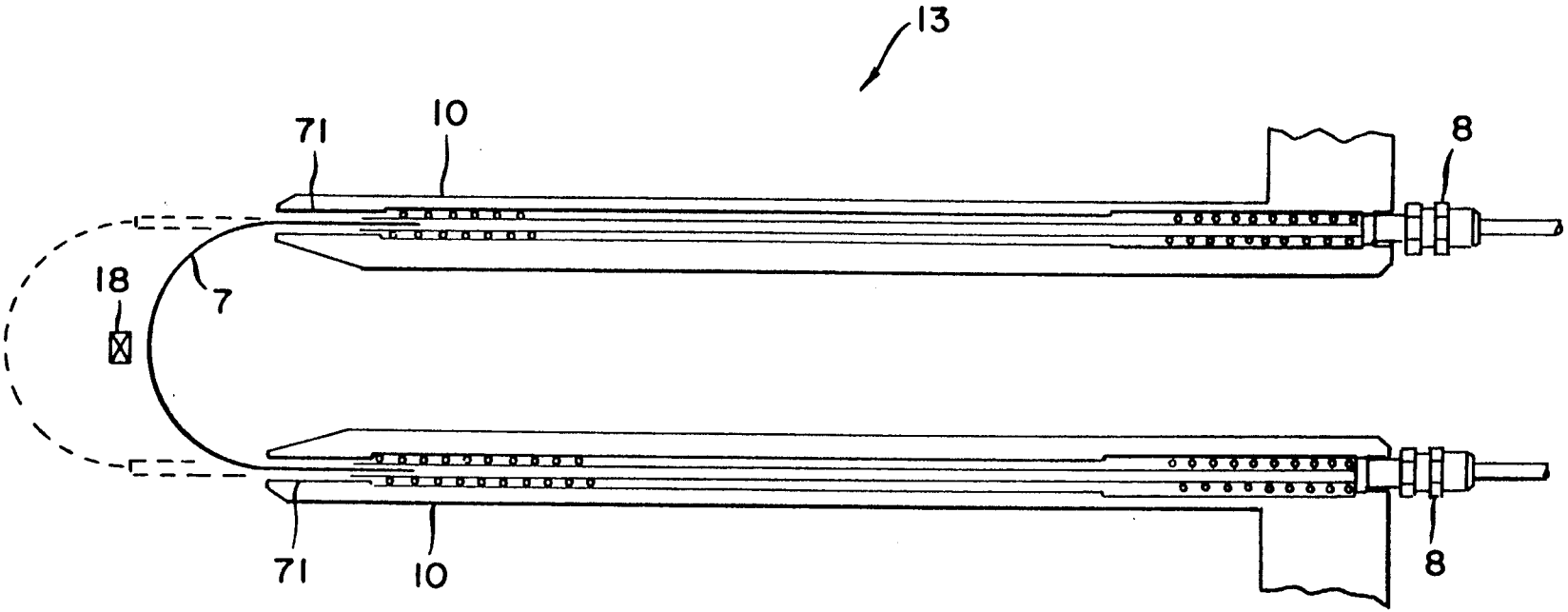
FIG. 1 is a plan view partly in section of a clamp of a pantyhose-sewing machine provided with an apparatus for the positioning of the stockings according to the invention.
Figure 2:
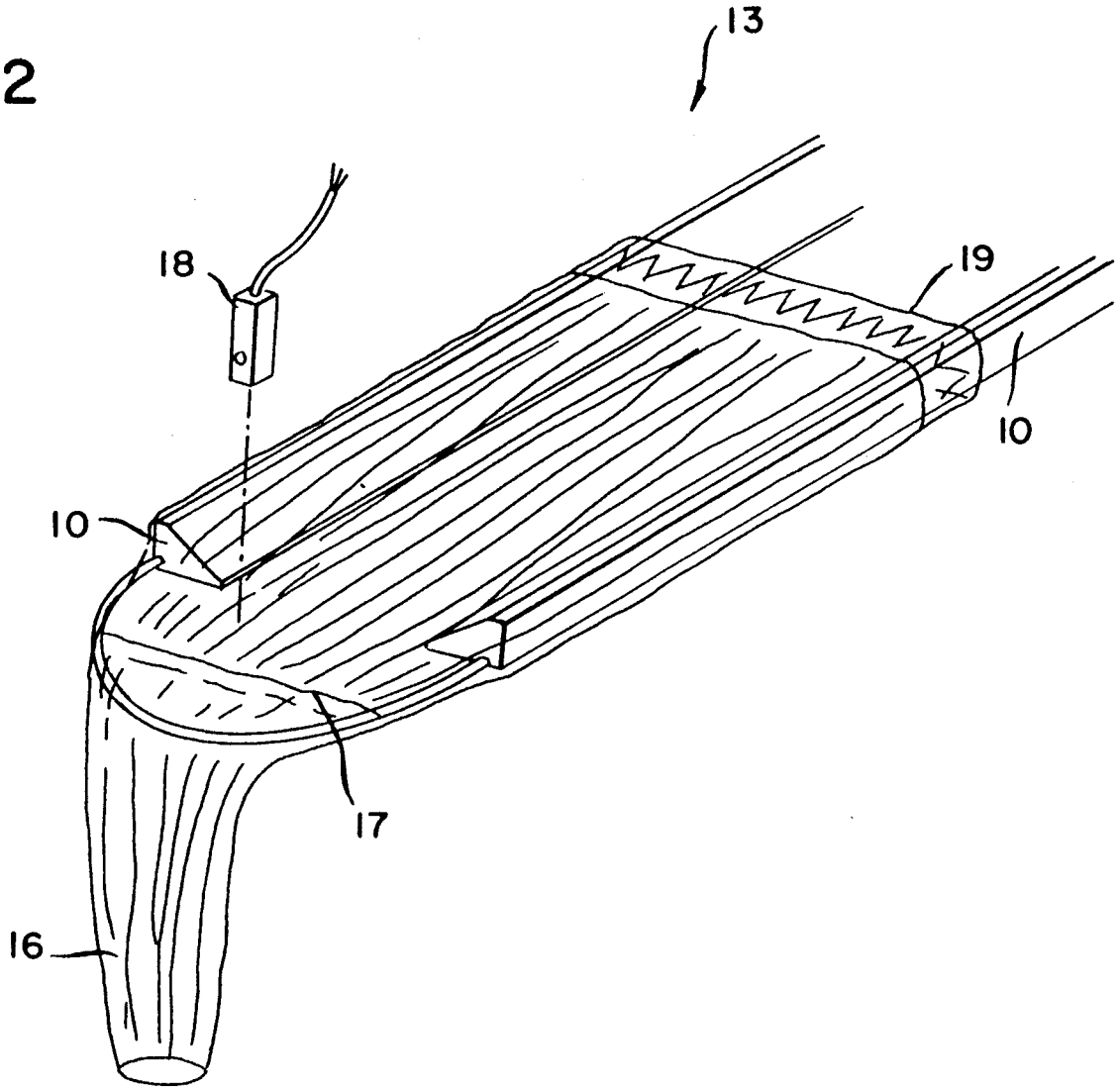
FIG. 2 shows a perspective view of the apparatus of FIG. 1 with the stretching bow in retracted condition.
Figure 3:
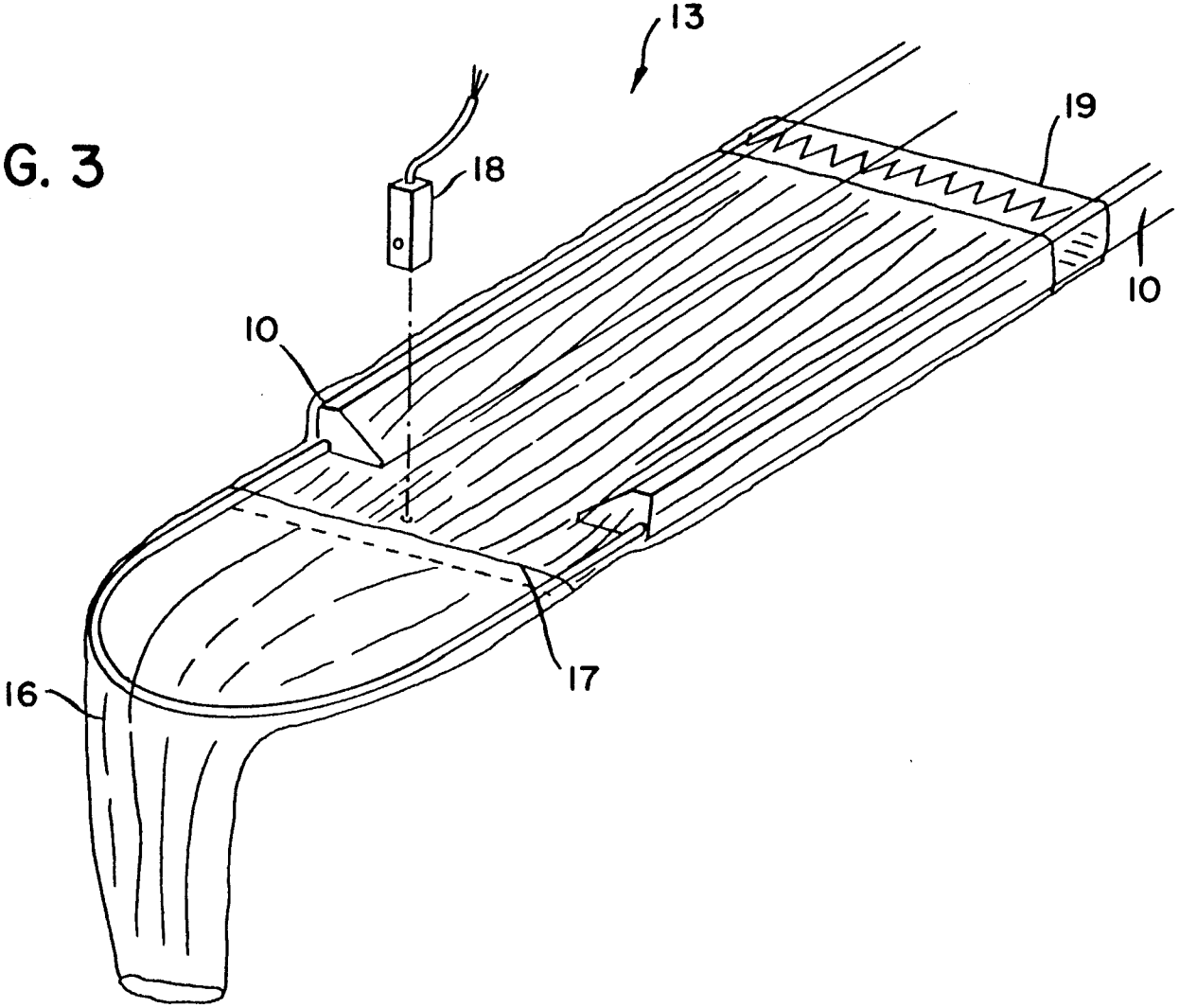
FIG. 3 shows the apparatus of FIG. 1 with the stretching bow in the extracted condition.
Figure 4:
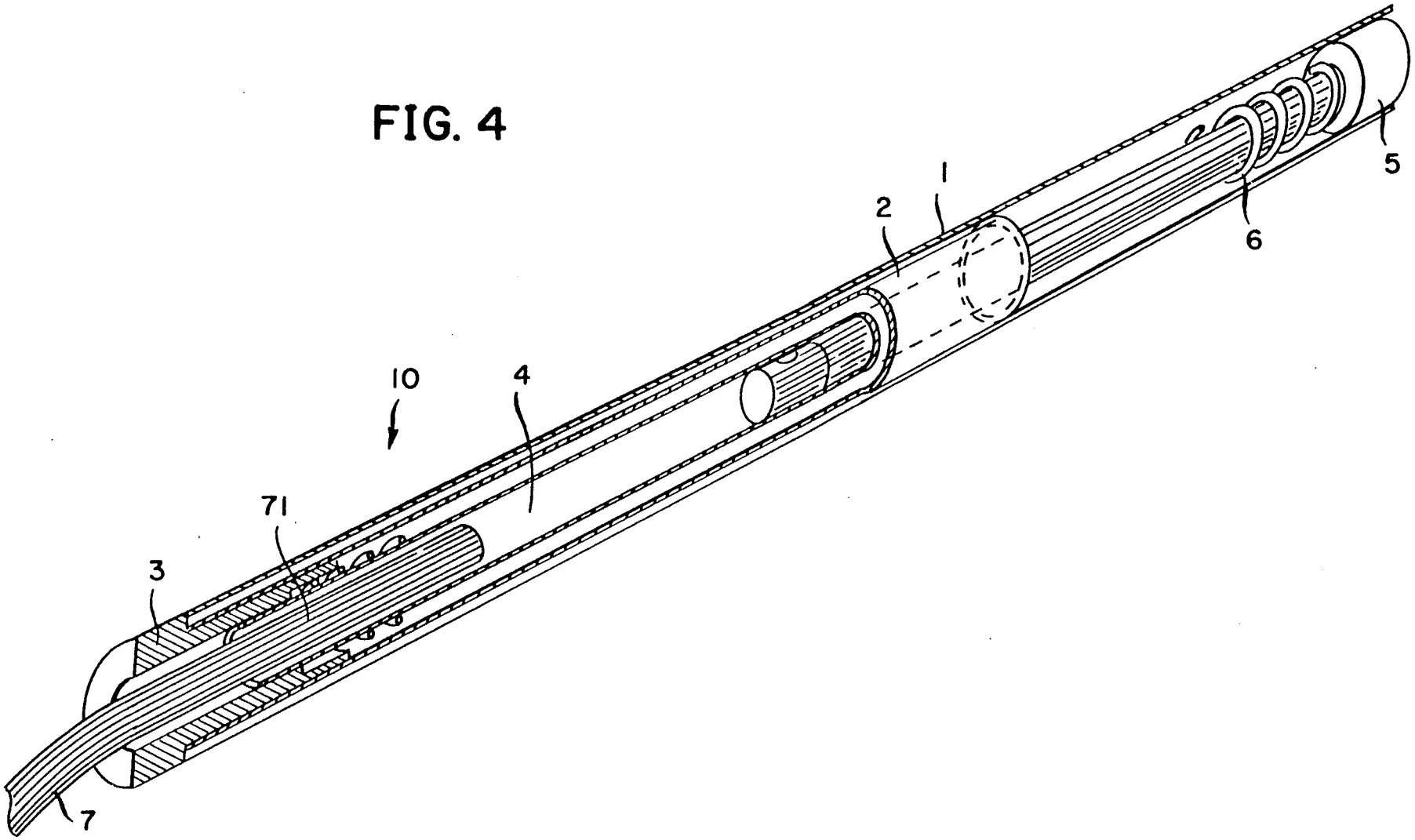
FIG. 4 shows the axonometric view partly in section of the stretching bow-driving and guiding device or means of the apparatus of FIG. 1.

Reduced to its basic structure, reference being made to FIGS. 1–4 of the attached drawings, an apparatus according to the invention—for the positioning of the stockings in a pantyhose-sewing machine with an optical sensor 18 for detecting the garter line and comprising two paired shapes for the support of the stockings, each shape 13 being provided with horizontal, articulated arms (10) whose ends are extended and joined by a nylon-thread bow 7 which is coplanar to the arms 10 and has its convexity facing the machine. Stems 71 of the bow 7 are slidingly received inside the arms 10 of the relevant shape in the longitudinal direction thereof between two positions, one of maximum retraction and the other of maximum extraction to allow the stocking to be stretched outwardly and before the shape, and with the optical sensor 18 in such a position that its vertical light beam will intercept the garter line 17 in the region stretched by the bow 7 and thus positioned outside and before the shape.

More particularly, the nylon bow 7 is engaged (a) to driving and guiding means provided in the two arms 10 of the shape 13 and comprising for each arm:

- a bored rod 4 with a shoe 5 on top of which the foot of the corresponding stem 71 of the bow 7 is fixedly engaged;
- a first hose 1 fitted solid on a second hose 2 internally gauged to guide the shoe 5 of the rod 4, a bush 3 being fixed on top of said hoses for guiding the tip of the rod 4;
- a thrust spiral spring 6, fitted on the rod 4 inside the hose 2 and suitably pressed between the bush (3) and the shoe 3 of the rod 4;

(b) pneumatic means for controlling the active stroke of the rod 4, that is, of the bow 7 stretching out of the of arms of the shape 13, with a fitting 8 mounted in alignment with the rod 4 in correspondence with the end of each arm 10 of the shape 13 opposite to the nylon bow 7.

The compressed air fed-in through the fitting 8 may be advantageously tapped out of the same air compression plant which any pantyhose-sewing machine is provided with.

Figure 5:
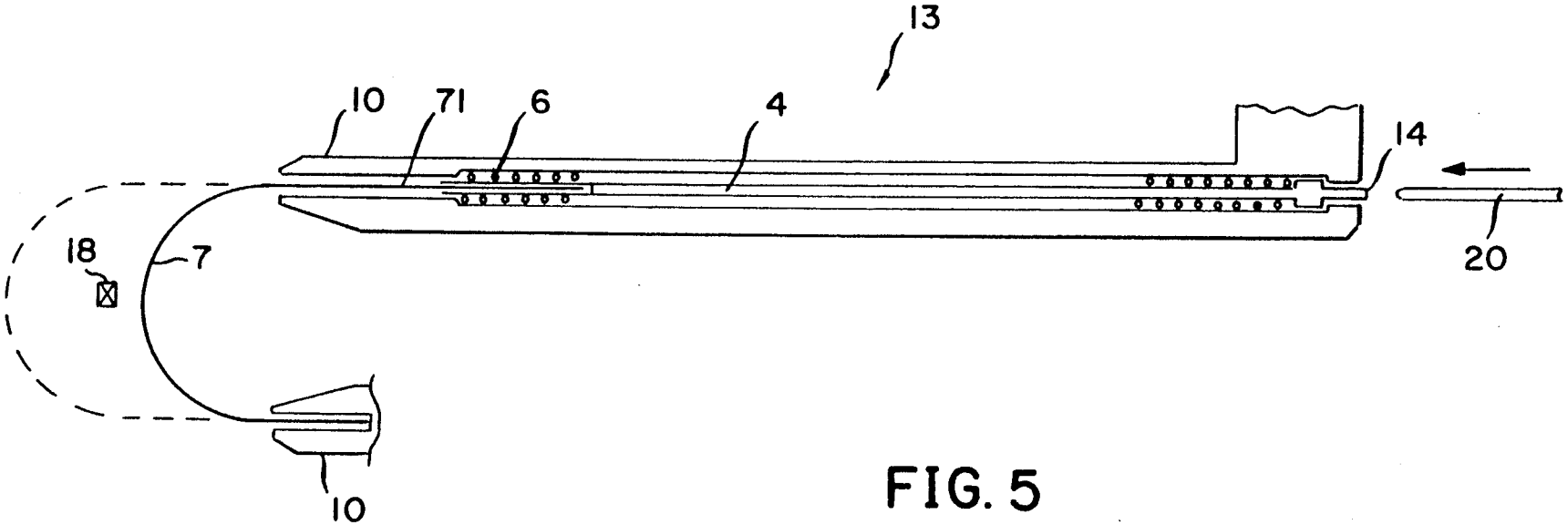
FIG. 5 shows the plan section view of an alternative embodiment of the stretching bow-operating means.

According to an alternative embodiment of the means for operating the stretching bow 7, reference being made to FIG. 5 of the attached drawings, the rods 4 have a stop element 14 on the side opposite to that of the guiding bush 3: the stop element 14 apt to be pushed inwardly of arms 10 by means of a pusher 20 causing the bow 7 to come out of arms 10.

Figure 6A:
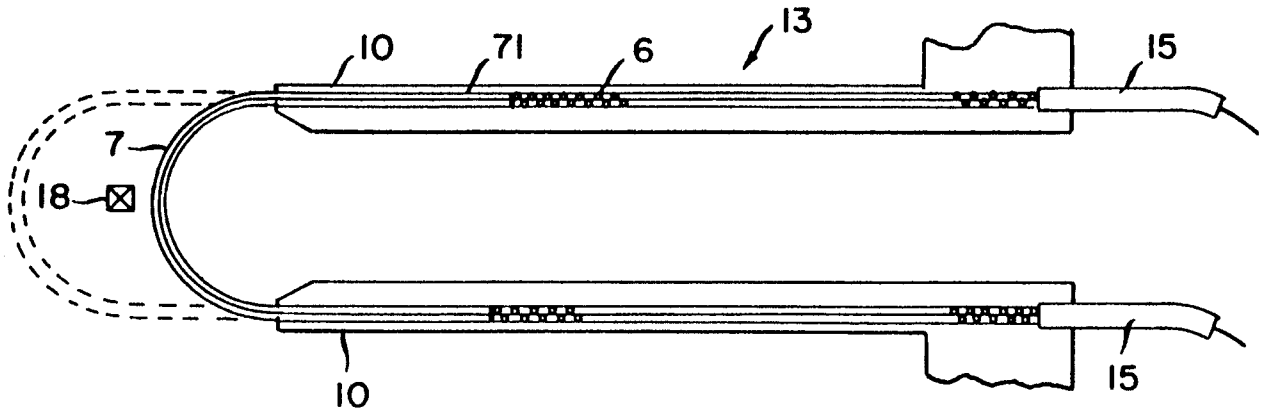
FIGS. 6A and 6B show the plan view and, respectively, the axonometric view of the stretching bow-operating means according to a further embodiment of the invention.
Figure 6B:
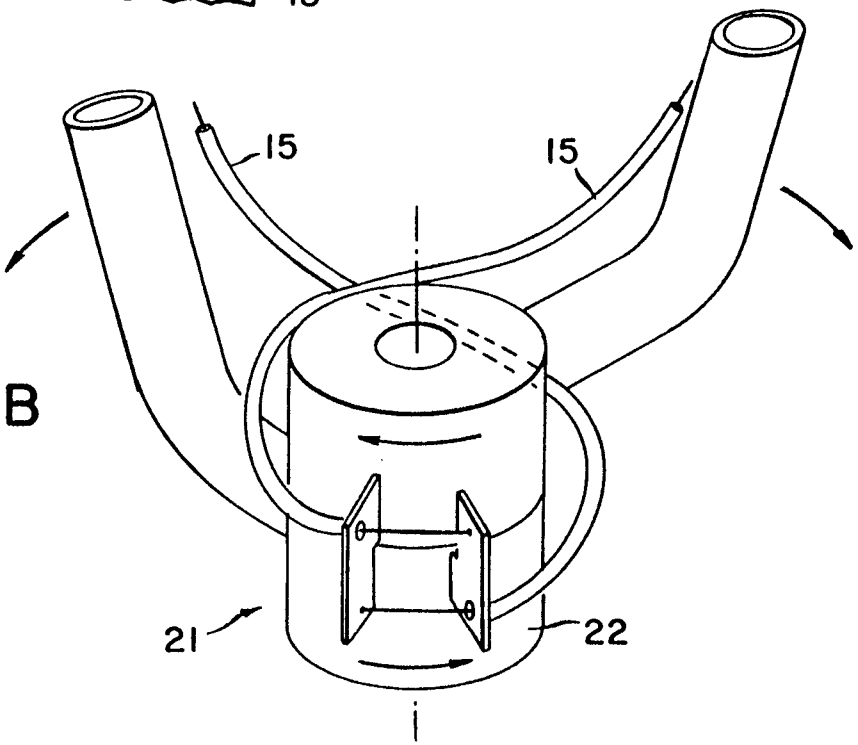

According to a further embodiment of the means for operating the stretching bow 7 and with reference to FIGS. 6A and 6B of the attached drawings, to the shoe 5 of the rod 4 which is received in the left 10 (respectively, right) arm of the shape 13 is fixed one end of a corresponding sheathed rope 15, the other end being fixed to a rotating part 21 of the articulation 22 corresponding to the right 10 (respectively left) arm of the shape 6, and the spring 6 is fitted on the rope 15 so that the draw of the two ropes 15 brings the stretching bow 7 to the retracted position and the loosening of the two ropes 15 allows the spring 6 to push the stretching bow 7 out of the shape 13.

The operation is as follows.

After a stocking 16 has been fitted around both the arms 10 and the stretching bow 7 of a shape 13 (see FIG. 1), compressed air is fed into the hoses 2 through the fittings 8, and the pressure exerted by the compressed air on the shoes 5 of the bored rods 4 causes the latter to move forward by overcoming the resistance of the springs 6. Consequently, the stretching bow 7 is forced out of arms 10 of the shape 13, and the region astride the garter line 17 is widened, that is, stretched, thereby eliminating the wrinkles and allow the photodetector 18 to distinctly detect the garter line 17. Upon completion of the stocking positioning operation, which is performed in a single step and consists in the displacement of the stocking over the shape 13 by moving away the elastic hem 9 thereof from the shape end until the sensor 18 detects the garter line 17, the intake of compressed air is stopped and the springs 6 retract the bored rods 4, together with the stretching bow 7, back into the shape 13.

Alternatively, according to the invention, provision is made for the stretching bow 7 being fixedly anchored to only one of the rods 4 to allow the driving thereof by acting on only one of its stems 71, which implies, therefore, the provision of only one arm 10 of shape 13 of the driving and guiding means: the other arm of the shape being simply bored lengthwise to allow the sliding of the other stem of bow 7 when this is either extracted or retracted.

The anchoring of the bow 7 to one of rods 4 results particularly advantageous to prevent the bow 7 from remaining in extracted condition and becoming flock-like deformed when the arms 10,30 of shape 13 are spread open prior to the sewing of the pantyhose.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. An apparatus for automatically positioning stockings in a pantyhose-sewing machine, the apparatus comprising:

a shape having first and second arms in substantially a same plane;

a bow having an end slidably engaged with one end of said first arm, said bow extending from said end of said first arm to an end of said second arm, said bow being substantially coplanar with said arms;

driving and guiding means for sliding said bow in and out of said first arm between a retraction position and an extraction position, said driving and guiding means including a bored rod attached to a shoe and a stem of said bow, said driving and guiding means also including a first hose and a second hose, said first hose being fitted on said second hose, said second hose defining an internal gauge for guiding said shoe of said bored rod, an end of said second hose having a push means for guiding an end of said bored rod, a spring positioned on said bored rod and inside said second hose, said spring also being positioned between said shoe and said brushing means;

garter line detection means positioned spaced from said shape and for detecting a garter line of a stocking positioned on said shape when said bow is in said extraction position.

2. A apparatus in accordance with claim 1, wherein:

another end of said bow is slidably engaged with said end of said second arm;

said driving and guiding means also slides said bow in and out of said second arm.

3. A apparatus in accordance with claim 1, wherein:

said driving and guiding means includes a compressed gas fitting and moves aid bow into said extracted position by compressed gas, said compressed gas fitting being mounted on another end of said first arm substantially opposite said bow, said compressed gas fitting also being positioned substantially in alignment with said bored rod and said first arm.

4. A apparatus in accordance with claim 1, wherein:

said driving and guiding means includes a mechanical pushing means for pressing said bored rod through said first arm to move said bow into said extraction position.

5. A apparatus in accordance with claim 1, wherein:

said driving and guiding means includes a flexible rope having one end attached to said shoe of said bored rod and another end of said flexible rope attached to an articulation of said second arm, drawing of said flexible rope by said articulation moving said bow into said retraction position and moving said spring into a compressed state, relaxation of said flexible rope causing said spring to expand and move said bow into said extraction position.

* * * * *